United States Patent [19]

Isota et al.

[11] Patent Number: 4,607,240

[45] Date of Patent: Aug. 19, 1986

[54] DIRECTIONAL COUPLER

[75] Inventors: Yoji Isota; Osami Ishida; Fumio Takeda, all of Kanagawa, Japan

[73] Assignee: Mitsubishi Denki Kabushiki Kaisha, Tokyo, Japan

[21] Appl. No.: 684,037

[22] Filed: Dec. 20, 1984

[30] Foreign Application Priority Data

Dec. 21, 1983 [JP] Japan ..... 58-196622[U]

[51] Int. Cl.[4] ..... H01P 5/18

[52] U.S. Cl. ..... 333/116; 333/238

[58] Field of Search ..... 333/116, 238, 246

[56] References Cited

U.S. PATENT DOCUMENTS 3,225,351 12/1965 Chatelain et al. ..... 333/238 X
3,370,256 2/1968 Baur et al. ..... 333/238 X
3,560,891 2/1971 MacLeary et al. ..... 333/116 X

FOREIGN PATENT DOCUMENTS 935014 11/1955 Fed. Rep. of Germany ..... 333/238
50702 4/1980 Japan ..... 333/238

OTHER PUBLICATIONS

Microstrip Lines and Slot Lines, K. C. Gupta et al., published by Artech House (1979), pp. 348–351.

Garg, *Stripline-Like Microstrip Configuration,* Microwave Journal, vol. 22, No. 4, Apr. 1979, pp. 103, 104, 116.

*Primary Examiner*—Paul Gensler

*Attorney, Agent, or Firm*—Bernard, Rothwell & Brown

[57] ABSTRACT

A directional coupler having a main line and an auxiliary line each formed within a groove formed in a dielectric plate, having good directivity and capable of tight coupling.

5 Claims, 18 Drawing Figures

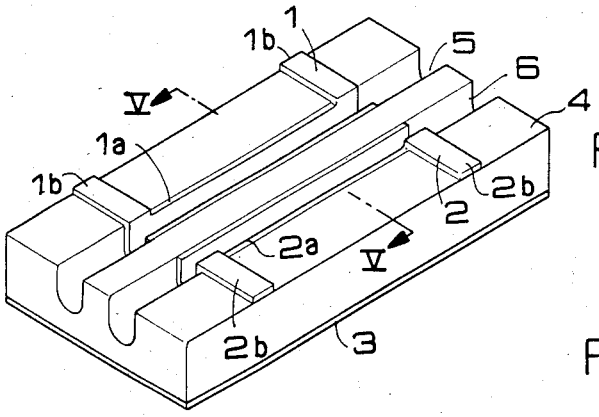
FIG. 5A
FIG. 5B
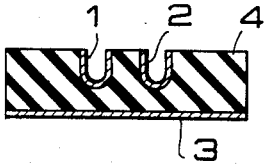
FIG. 7A
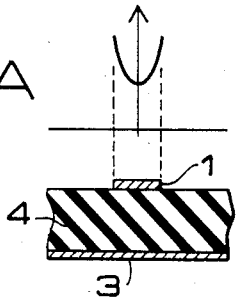
FIG. 6A
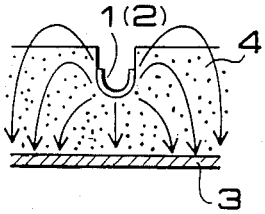
FIG. 7B
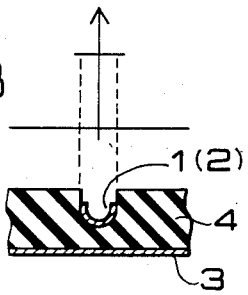
FIG. 6B
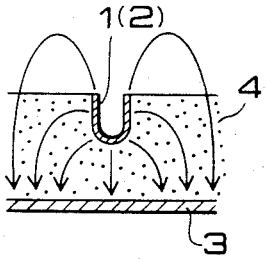
FIG. 7C
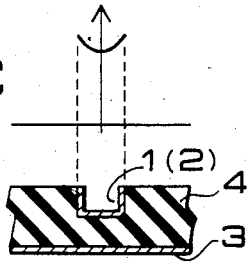

DIRECTIONAL COUPLER

BACKGROUND OF THE INVENTION

1. Field of the Invention

The present invention relates to improvements in a directional coupler formed on a dielectric plate.

2. Description of the Prior Art

Directional couplers of such a kind as shown in FIGS. 1A, 1B and 2A, 2B have been proposed. In each of these figures indicated at 1 is a main line, at 2 is an auxiliary line, at 3 is a ground member and at 4 is a dielectric plate. In the directional coupler of FIGS. 1A and 1B the main line 1 is formed of a coupling part 1*a* and arms 1*b* extending diagonally from the opposite ends of the coupling part 1*a*. The auxiliary line 2 is formed likewise. In the directional coupler of FIGS. 2A and 2B the main line 1 is formed of a coupling part 1*a* and arms 1*b* extending from the opposite ends of the coupling part 1*a* practically perpendicularly to the coupling part 1*a* and a chamfered part 1*c* is formed in each arm 1*b* at the junction of the arm 1*b* and the coupling part 1*a*. The auxiliary line 2 has the same construction as that of the main line 1. Thus the directional couplers of the prior art shown in FIGS. 1A, 1B and 2A, 2B have substantially the same constructions except the morphology of the main lines 1 and the auxiliary lines 2.

Generally, directional couplers as shown in FIGS. 1A, 1B and 2A, 2B are required to meet the following conditions for satisfactory directivity and high degree of coupling:

Condition 1: Equality of the odd mode effective specific inductive capacity $E_{odd}$ and the Even mode effective specific inductive capacity $E_{even}$ of the coupling line for satisfactory directivity: and Condition 2: Large electrostatic capacity between the coupling lines for high degree of coupling.

However, since the electric field leaks more in the odd mode than in the even mode in the conventional directional coupler, the conventional directive coupler was unable to meet the Condition 1 and had an unsatisfactory directivity. Reduction in the distance between the lines by increasing the thickness of the conductive strip contributes to increasing the electrostatic capacity between the lines to meet the Condition 2, however, the maximum degree of coupling thus obtained is, at the most —6dB, which is not satisfactory.

SUMMARY OF THE INVENTION

The present invention has been made to provide a directive coupler having a very high directivity and capable of tight coupling, through the elimination of disadvantages of the conventional directive couplers. Accordingly, it is an object of the present invention to provide a directional coupler having a main line and an auxiliary line each being formed of a conductive strip extended within a groove formed in one side of a dielectric plate, and a ground body attached to the other side of the dielectric plate.

BRIEF DESCRIPTION OF THE DRAWINGS

FIG. 5A is a perspective view of a directional coupler, in a third embodiment, according to the present invention;

FIG. 5B is a sectional view taken along line V—V of FIG. 5A;

FIGS. 6A and 6B are illustrations showing the forms of lines in grooves and the corresponding electric fields in the embodiment of FIG. 4 and the embodiment of FIG. 5 respectively;

FIGS. 7A, 7B and 7C are illustrations showing the dispositions of the line with respect to the dielectric plate and the corresponding surface currents in a conventional directional coupler, in the embodiment of FIG. 4 and in a directional coupler having a rectangular groove respectively;

DETAILED DESCRIPTION OF THE PREFERRED EMBODIMENTS

Figure 1A:
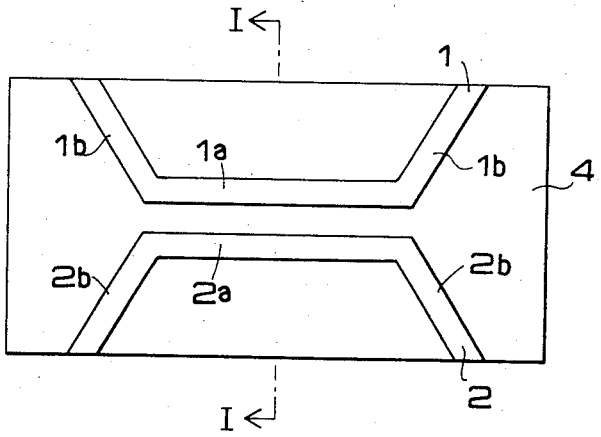
FIG. 1A (PRIOR ART)
FIG. 1A is a plan view of a conventional directive coupler.
Figure 1B:
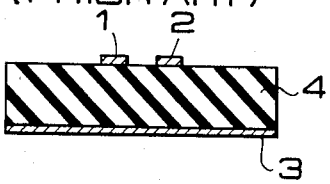
FIG. 1B (PRIOR ART)
FIG. 1B is a sectional view taken along line I—I of FIG. 1A.
Figure 2A:
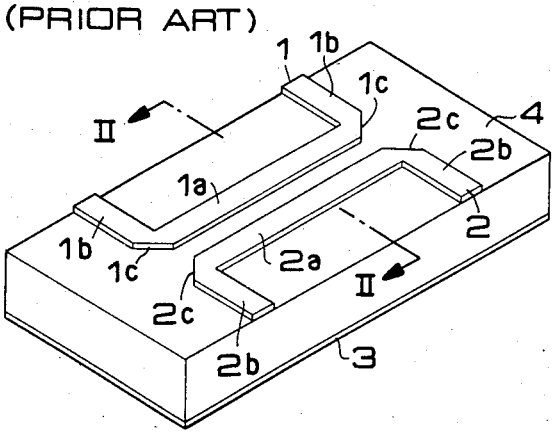
FIG. 2A (PRIOR ART)
FIG. 2A is a perspective view of another conventional directive coupler.
Figure 2B:
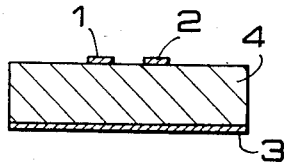
FIG. 2B (PRIOR ART)
FIG. 2B is a sectional view taken along line II—II of FIG. 2A.

The embodiments of the present invention will be described in detail hereinafter in connection with FIGS. 3 to 9. In FIGS. 1 through 9, like reference characters designate like or corresponding parts throughout, and hence the explanation thereof will be omitted discretionarily.

Figure 3A:
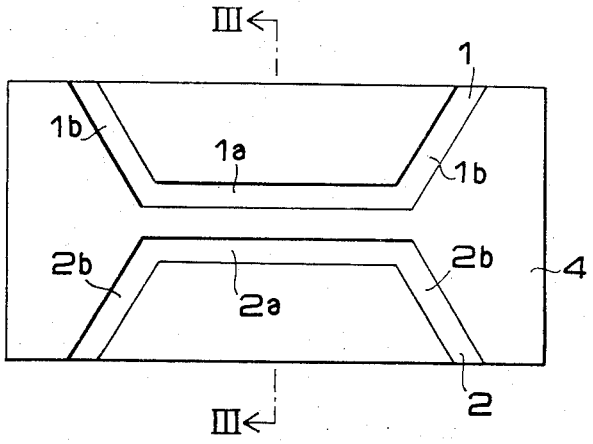
FIG. 3A is a plan view of a directional coupler, in a first embodiment, according to the present invention.
Figure 3B:
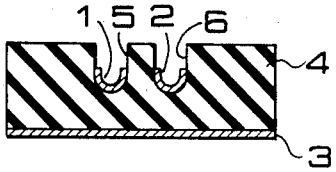
FIG. 3B is a sectional view taken along line III—III of FIG. 3A.

In FIGS. 3A and 3B, indicated at 5 and 6 are grooves formed in a dielectric plate 4. A main line 1 and an auxiliary line 2 are formed in the grooves 5 and 6 formed in the dielectric plate 4 respectively. Accordingly, the even mode and the odd mode are almost the same in leakage electric field outside the dielectric plate 4, which meets the Condition 1 and provides satisfactory directivity. As shown in FIG. 3B in a sectional view, the main line 1 and the auxiliary line 2 are provided in the grooves 5 and 6 each of a semicircular section and the opposite ends of each line are raised up. The line of such a morphology is equivalent to a thick strip line. Accordingly, the electrostatic capacity between the coupling lines is increased without increasing the interval between the lines, which meets the Condition 2 and enables tight coupling.

In a first embodiment of the present invention shown in FIGS. 3A and 3B, the main line 1 and the auxiliary line 2 are provided on the respective bottom surfaces of the grooves 5 and 6 respectively. As shown in FIGS. 4A, 4B, 5A and 5B, it is also possible to form the main line 1 and the auxiliary line 2 with their arms placed on the upper surface of the dielectric plate 4, with their coupling parts 1*a* and 2*a* placed inside the grooves 5 and 6 respectively and with the arms 1*b* and 2*b* extended practically perpendicularly to the corresponding coupling parts.

The main line 1 and the auxiliary line 2 can easily be formed in the dielectric plate 4, for example, by the application of the thick film printing technique. In printing conductive films for the main line and the auxiliary line, theoretically, the possible thickness of the conductive film is the same or greater than the film thickness $\delta$ defined by a formula:

$$\delta = \frac{1}{\sqrt{\pi f \mu \sigma}}$$

where f is frequency, $\mu$ is magnetic permeability and $\sigma$ is conductivity. The film thickness decreases as frequency increases. Ordinarily, the film thickness may be 10 to 50 $\mu$m.

The embodiments shown in FIGS. 4A, 4B, 5A and 5B will be described in terms of their functions.

Figure 4A:
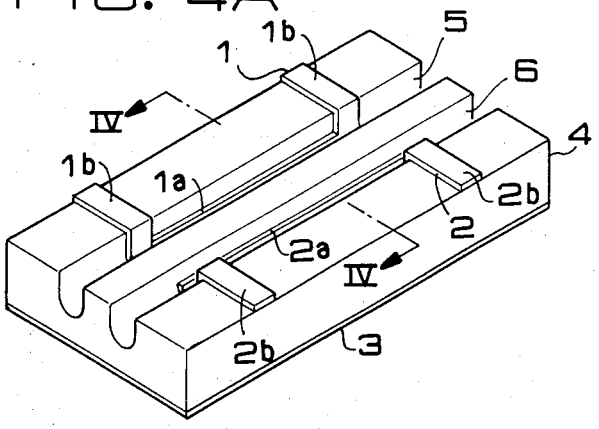
FIG. 4A is a perspective view of a directional coupler, in a second embodiment, according to the present invention.
Figure 4B:
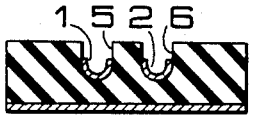
FIG. 4B is a sectional view taken along line IV—IV of FIG. 4A.

When the conductive strip is formed over part of the side surfaces and the bottom surface of the groove as shown in FIG. 4B, only a small part of the magnetic field leaks into the atmosphere as shown in FIG. 6A and the effective dielectric constant $E_{eff}$ is increased. Accordingly, a compact coupler of a large shortening coefficient of wavelength can be formed by reducing the length of the coupling part. When the conductive strip is formed over the entire surface of the groove as shown in FIG. 5B, the working of the conductive strip is easier as apparent from FIG. 6B than the working of the conductive strip of FIG. 6A. Furthermore, since the opposing area between the electrodes is increased, a high degree of coupling is provided.

Although the invention has been described as applied to a directional coupler having grooves each of a semicircular cross section, the present invention is not limited thereto, but may be applied to a directional coupler having grooves each of a rectangular cross section. However, from the view point of radiation loss, grooves of a semicircular cross section or a U-shaped cross section are advantageous. That is, as seen in FIGS. 7A, 7B and 7C, most uniform distribution of surface current is obtained and the radiation loss at the ends of the line is reduced when the grooves are formed in a U-shaped cross section as shown in FIG. 7B.

Effective specific inductive capacity will be explained hereinafter for reference.

Figure 8A:
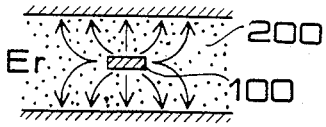
FIG. 8A is an illustration showing the dependence of the effective dielectric constant on the positional relation between the conductive member and the dielectric member in a directional coupler in which the conductive member is placed within the dielectric member.

In case an inner conductive body 100 is surrounded by a dielectric body 200 as shown in FIG. 8A, the electromagnetic field is formed entirely within the dielectric body 200, hence the effective dielectric constant $E_{eff}$ is equal to $E_r$.

Figure 8B:
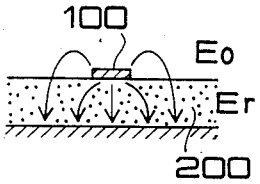
FIG. 8B is an illustration similar to FIG. 8A, in which the conductive member is placed on the dielectric member.
Figure 9:
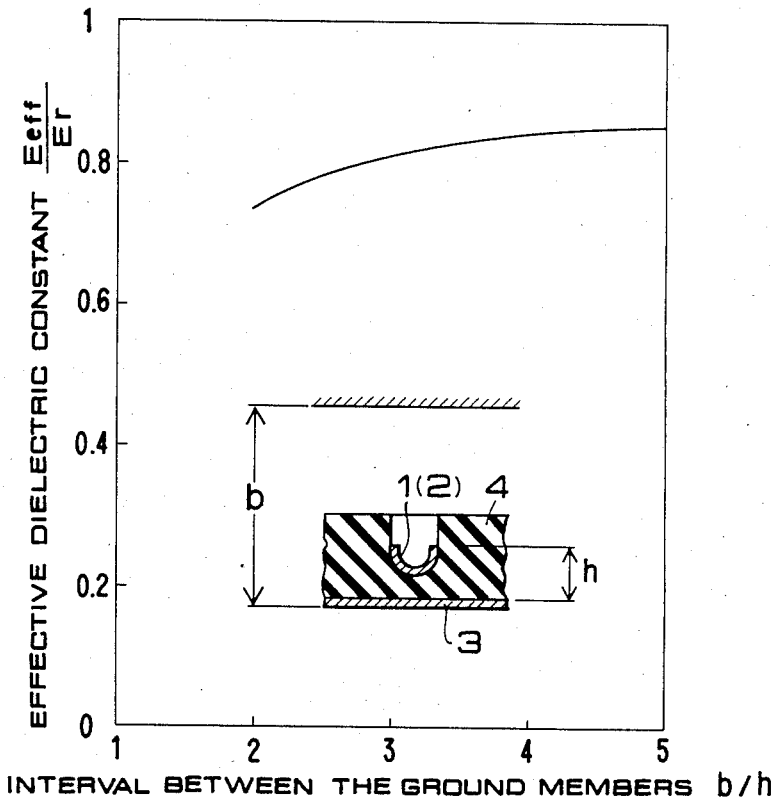
FIG. 9 is a conceptional illustration showing the relation between the interval between the ground members and effective dielectric constant.

In case the inner conductive body 100 is located on the surface of the dielectric body 200 as shown in FIG. 8B, part of the electromagnetic field leaks into the atmosphere. Consequently, the effective dielectric constant $E_{eff}$ is smaller than specific inductive capacity $E_r$.

The effective dielectric constant $E_{eff}$ is defined by a formula $$E_{eff} = C/C_0$$

where C is the electrostatic capacity between an inner conductive body and an outer conductive body when a dielectric body is provided and $C_0$ is the electrostatic capacity when no dielectric body is provided. The relation between the ground body interval b/h and the effective dielectric constant in the embodiment of FIGS. 4A and 4B is represented by a characteristic curve shown in FIG. 9.

What is claimed is:

1. A directional coupler comprising a dielectric plate, first and second closely adjacent grooves formed in one surface of said plate and a ground member formed on the opposite surface of said plate, said grooves in cross section being smoothly curved at the bottoms thereof, a main line and an auxiliary line comprising a coupling junction, said main line being formed of a conductive strip positioned in said first groove, said auxiliary line being formed of a conductive strip positioned in said second groove, and arms connected to opposite ends of said main line and said auxiliary line and disposed on said one surface of said dielectric plate.

2. A directional coupler according to claim 1, wherein each of said grooves has a U-shaped cross section.

3. A directional coupler according to claim 1, wherein the coupling junction between said main line and said auxiliary line is formed over the entire depth of the grooves.

4. A directional coupler according to claim 1, wherein the coupling junction between said main line and said auxiliary line is concentrated near the bottom portion of the grooves.

5. A directional coupler according to claim 1, wherein the cross section of each of said grooves has a semicircular shape.

* * * * *